US006966672B2

(12) United States Patent
Feistmantl

(10) Patent No.: US 6,966,672 B2
(45) Date of Patent: Nov. 22, 2005

(54) LUMINAIRE LOUVRE WITH DOUBLE-WALLED SIDE REFLECTORS

(75) Inventor: Reinhard Feistmantl, Lustenau (AT)

(73) Assignee: Zumtobel Staff GmbH, Dornbirn (AT)

( * ) Notice: Subject to any disclaimer, the term of this patent is extended or adjusted under 35 U.S.C. 154(b) by 0 days.

(21) Appl. No.: 10/986,009

(22) Filed: Nov. 12, 2004

(65) Prior Publication Data

US 2005/0117345 A1 Jun. 2, 2005

Related U.S. Application Data

(63) Continuation of application No. PCT/EP03/03938, filed on Apr. 15, 2003.

(30) Foreign Application Priority Data

May 15, 2002 (DE) ..... 102 21 630

(51) Int. Cl.[7] ..... F21V 7/00

(52) U.S. Cl. ..... 362/290; 362/342; 362/396

(58) Field of Search ..... 362/290, 291, 362/292, 297, 342, 354, 346, 396

(56) References Cited

U.S. PATENT DOCUMENTS

| | | | | |
|---|---|---|---|---|
| 2,619,583 A | | 11/1952 | Baumgartner | 240/51.11 |
| 4,717,992 A | * | 1/1988 | Bartenbach et al. | 362/290 |
| 5,264,999 A | * | 11/1993 | Kempter | 362/342 |
| 5,697,591 A | * | 12/1997 | Cooper | 362/396 |
| 6,155,693 A | | 12/2000 | Spiegel et al. | 361/147 |

FOREIGN PATENT DOCUMENTS

| | | |
|---|---|---|
| CH | 673 047 A5 | 1/1990 |
| DE | 75 22 065 | 1/1976 |
| DE | 32 25 544 A1 | 1/1984 |
| DE | 37 04501 A1 | 9/1987 |
| DE | 88 01 786 U | 3/1988 |
| DE | 196 20 209 A1 | 11/1997 |
| GB | 2 300 471 A1 | 11/1996 |

* cited by examiner

*Primary Examiner*—Y. My Quach-Lee
(74) *Attorney, Agent, or Firm*—Fitzpatrick, Cella, Harper & Scinto

(57) ABSTRACT

A luminaire louvre (1) for an elongate luminaire comprises two elongate side reflectors (2) and a plurality of transverse lamellas (10). The side reflectors (2) in each case have an inner wall (3) and an outer wall (4), which transition into one another in one piece.

13 Claims, 7 Drawing Sheets

LUMINAIRE LOUVRE WITH DOUBLE-WALLED SIDE REFLECTORS

CROSS REFERENCE TO RELATED APPLICATIONS

This is a Continuation of application PCT/EP03/03938 filed on Apr. 15, 2003, and published in German but not English as WO 03/098101 A1 on Nov. 27, 2003, the priority of which is claimed herein (35 U.S.C. §120) and which claims priority of German Application No. 102 21 630.4 filed May 15, 2002, the priority of which is also claimed herein (35 U.S.C. §119).

BACKGROUND OF THE INVENTION

1. Field of the Invention

The present invention relates to a luminaire louvre for an elongate luminaire, the side reflectors of which have each an inner wall and an outer wall.

2. Description of the Related Art

In the case of luminaires provided for the illumination of work areas, so-called louvres are often employed in order to direct the light issued from the light source into a predetermined emission direction and to avoid dazzle effects. A conventional luminaire louvre thereby consists of two elongate side reflectors and a plurality of transverse reflectors, the so-called transverse lamellas, arranged transversely thereto. The transverse lamellas are in each case connected with their end faces to the side reflectors, which is effected for example by means of a latching. For this purpose, the side reflectors have appropriate apertures into which parts of the end faces of the lamellas engage.

The applicant distributes a luminaire under the designation or product name "RTX" in the case of which the apertures of the side reflectors and the end regions of the transverse lamellas engaging therein are deliberately kept visible. Through this the luminaire is lent a distinctive appearance having a technical character.

On the other hand, efforts are being made to form luminaire louvres with a completely smooth outer wall. This, however, means that the mountings or latch recesses employed for fastening the transverse lamellas must not be visible. From DE 196 20 209 A1 there is therefore known a luminaire louvre the side reflectors of which are formed in a double-walled manner. Through this, a hollow chamber is formed between the two walls into which the projecting fastening brackets of the transverse lamellas engage. Since this hollow chamber is covered over by the outer wall of the side reflector, the fastening brackets of the transverse lamellas are not visible from the outside and the luminaire louvre has a completely smooth outer side.

In the case of the luminaire louvre of DE 196 20 209 A1, a side reflector is formed by means of two separate parts, which form the inner and outer walls and at their longitudinal sides in each case engage into one another in latching manner. Such a structure, which in a similar manner is also known from DE 37 04 501 A1, is relatively complex and requires an additional working step in the mounting of a louvre.

Double-walled side reflectors for luminaires are further also known from DE 88 01 786.9 and CH 673 047 A5. DE 88 01 786.9 describes a long field luminaire which is provided for use in clean rooms. Here, there is provided below the light source a so-called mirror housing the side regions of which in each case have an inner wall used as a reflector surface and an outer wall, which walls transition into one another at their ends away from the light source. The mirror housing is thereby connected with a carrier element of the luminaire via separate latch devices which are arranged on the end faces of the mirror housing.

Also in the case of the luminaire known from CH 673 047 A5 the reflector provided for light emission is double-walled with inner and outer walls transitioning into one another. Here, the outer walls are upwardly extended and at their ends so structured that the reflector can be suspended in a grid of a plurality of longitudinal and transverse bars. Through this there is made possible a simple arrangement of the reflector and therewith of the luminaire, but this solution is practical only with a raster ceiling such as is described in CH 673 047 A5.

SUMMARY OF THE INVENTION

An object of the present invention is thus to indicate a luminaire louvre having double-walled side reflectors, which can be assembled and fastened to a luminaire in a simple manner.

This object is achieved by means of a luminaire louvre which has the following features. The luminaire louvre in accordance with the invention comprises again initially of two elongate side reflectors and a plurality of transverse lamellas, wherein the side reflectors in each case have an inner and an outer wall. In accordance with the invention there is now provided at least one clamp element which engages over and holds together edge regions of the inner and outer wall of a side reflector which lie on one another, and which further has fastening means for fastening the luminaire louvre to a luminaire.

Further developments of the invention are described and claimed herein Thus, the inner and outer walls of a side reflector preferably transition into one another in one piece. A side reflector is thus no longer formed of two separate parts which must be assembled together. Instead, a single appropriately formed sheet part is employed, which is brought into a substantially V-like structure. By these means, on the one hand the stability of the side reflector is increased, on the other hand the assembly and the mounting of the luminaire louvre is simplified.

Thus, the one-piece transition region—seen in cross-section of the luminaire louvre—is preferably located at the end of the inner and outer walls lying opposite to the luminaire. A side reflector is then initially prefabricated in a form in which the later inner and outer walls still stand apart from one another in a V-shape. Through this, the transverse lamellas can be fastened to the inner wall by hand mounting. After the mounting of the transverse lamellas the two walls are then pressed against one another so that at their ends opposite to the transition region they form edge regions lying on one another. With the aid of the clamp element, which engages over these edge regions, the inner and outer wall can then be held in the appropriate form and at the same time the luminaire louvre can be fastened to a luminaire.

Preferably, the clamp element is formed substantially U-shaped, whereby the fastening means are formed by means of a latching nose standing out of the U-shaped contour. A particularly preferred structure of the clamp element consists in that this has a first side wall in which at least one first recess is provided. Further, the clamp element has a second side wall which in a first section is directed towards the first side wall and in a second section is bent away from the first side wall, whereby in the region of the bend edge between the first and the second section at least one further recess is provided, which has a peaked projection which in continuation of the direction of the second section projects into the region of the first recess of the first side wall. Preferably, in each case two such clamp elements are provided in order to hold together the inner and outer walls of a side reflector.

The fastening of the transverse lamellas with the inner walls of the side reflectors is effected preferably by means of latching. Thereby, the transverse lamellas may be formed in particular in one piece and approximately V-shaped in cross-section, whereby at their end faces in each case brackets are formed which have cam-like projections and engage into correspondingly formed recesses in the inner walls. The recesses of the inner walls of the side reflectors then have approximately the shape of an isosceles triangle, whereby the recesses in each case are continued as a slot at the ends of the equal length sides of the triangle and the upper edges of the brackets of the transverse lamellas are held in the slots in an exactly fitting manner. Alternatively to the above-described V-shaped formed transverse lamellas, there is also the possibility of forming them of a sheet strip ribbed on both sides.

The present invention also relates to a clamp element for a luminaire louvre which is comprised of two elongate side reflectors and a plurality of transverse lamellas, the side reflectors of which in each case have an inner wall and an outer wall, wherein the clamp element in accordance with the invention is constituted to engages over and hold together edge regions of the inner and outer wall of a side reflector which lie on one another, and further has fastening means for fastening the luminaire louvre to a luminaire.

BRIEF DESCRIPTION OF THE DRAWINGS

Below, the invention will be described in more detail with reference to the accompanying drawings.

DETAILED DESCRIPTION OF THE PREFERRED EMBODIMENTS

Figure 1:
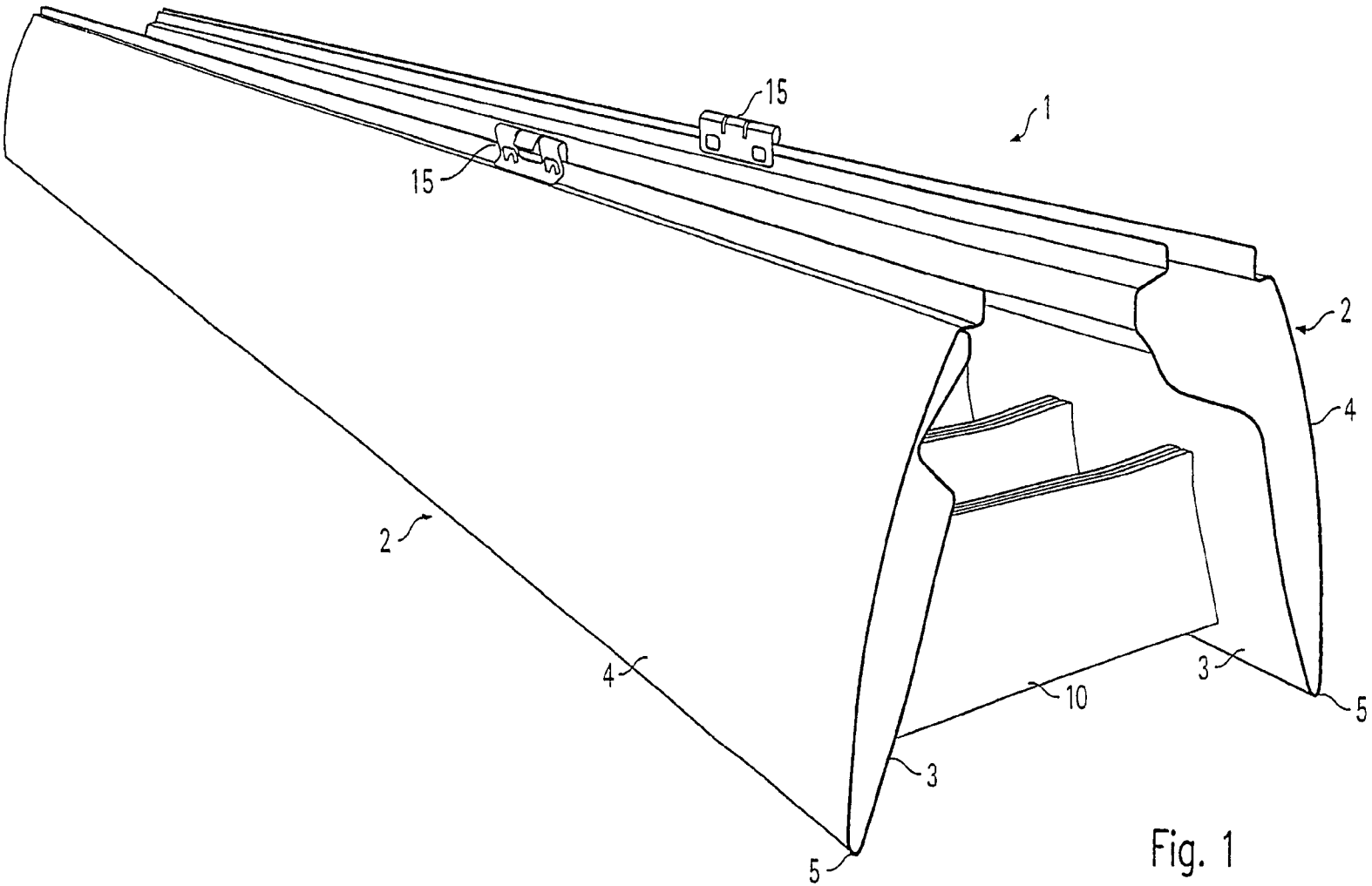
FIG. 1 is an exemplary embodiment of the luminaire louvre in accordance with the invention, in perspective view.

The basic framework of the elongate luminaire louvre 1 illustrated in FIG. 1 is formed by two elongate side reflectors 2 which are connected with one another via a series of transverse lamellas 10. At its two end faces, the louvre 1 is [closed off] by two end walls, the illustration of which is however omitted in the drawing for better explanation of the arrangement of the transverse lamellas 10. The side reflectors 2 are in each case double-walled with an inner wall 3 and an outer wall 4, wherein the transverse lamellas 10 are latched in each case with their end regions to the inner walls 3 of the side reflectors 2. Between an inner wall 3 and an outer wall 4 of a side reflector 3 there is formed a hollow chamber 6 into which the fastening brackets arranged on the end faces of the transverse lamellas 10 engage.

The particular characteristic of the luminaire louvre in accordance with the invention lies in the one-piece nature of the side reflectors 2. These are of a single sheet part which is bent to the illustrated V-shaped structure. At their ends opposite to the one-piece transition, which corresponds to an apex 5 of the V-shape, the inner and outer wall 3 and 4 in each case have edge regions 3*a* and 4*a* lying on one another. By means of a clamp element 15 engaging over these edge regions 3*a*, 4*a*, the two walls 3 and 4 of a side reflector 2 are held in the illustrated shape. The precise configuration of the clamp element 15 will be explained below in detail.

Figure 3:
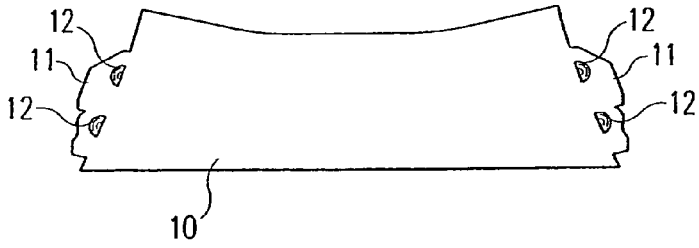
FIG. 3 is a front view of an individual transverse lamella of the luminaire louvre illustrated in FIG. 1.

The transverse lamellas are—seen in section—configured in known manner to be V-shaped and are closed at their upper edge by means of so-called beadings. A correspondingly formed transverse lamella 10 is illustrated in side view in FIG. 3. At its two end faces it has in each case two brackets 11 which additionally have a plurality of knob-like projections 12. The projections 12 can be obtained by means of appropriate stampings.

Figure 2:
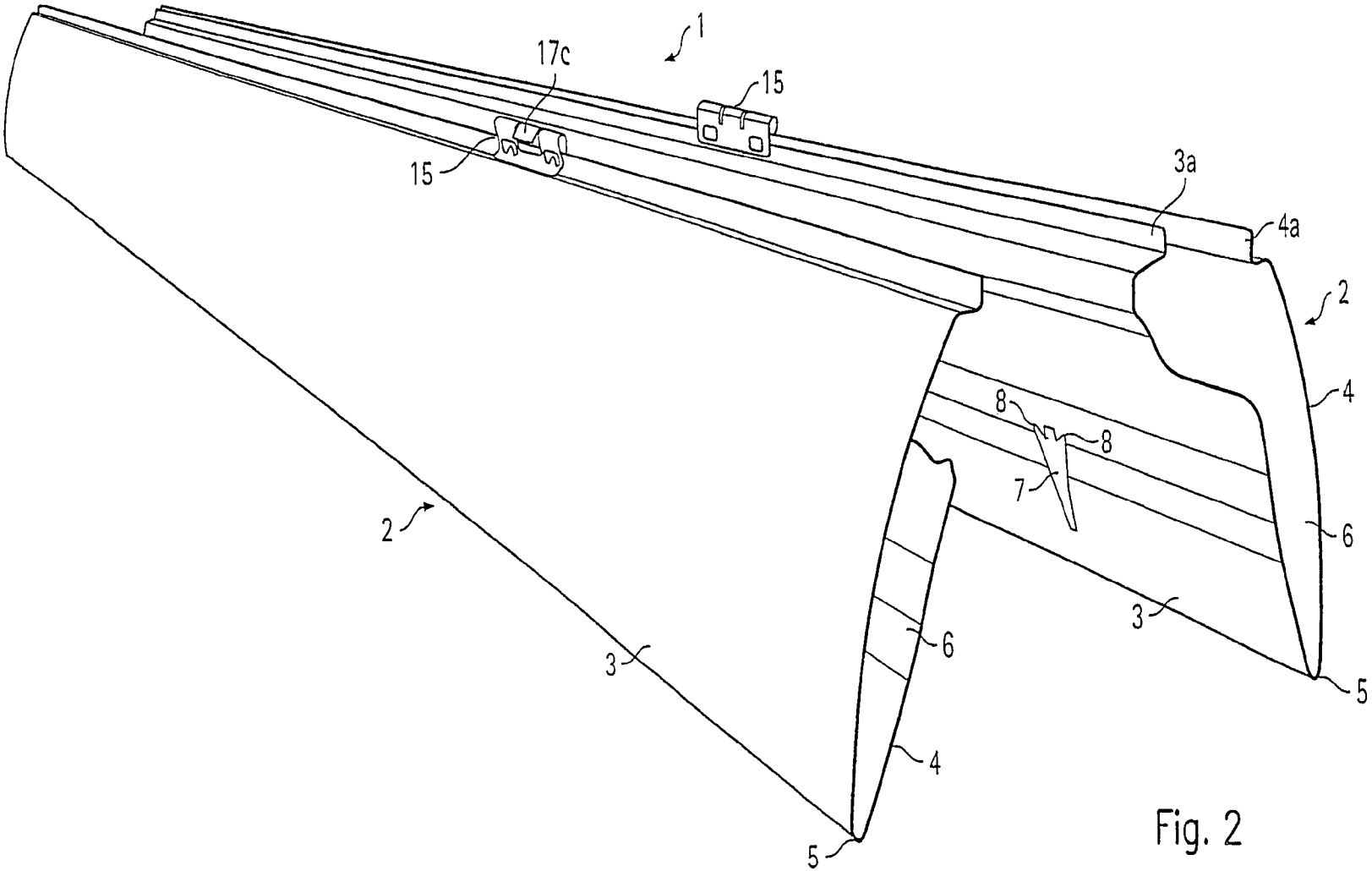
FIG. 2 is a perspective view showing the luminaire louvre of FIG. 1, without transverse lamellas.
Figure 4:
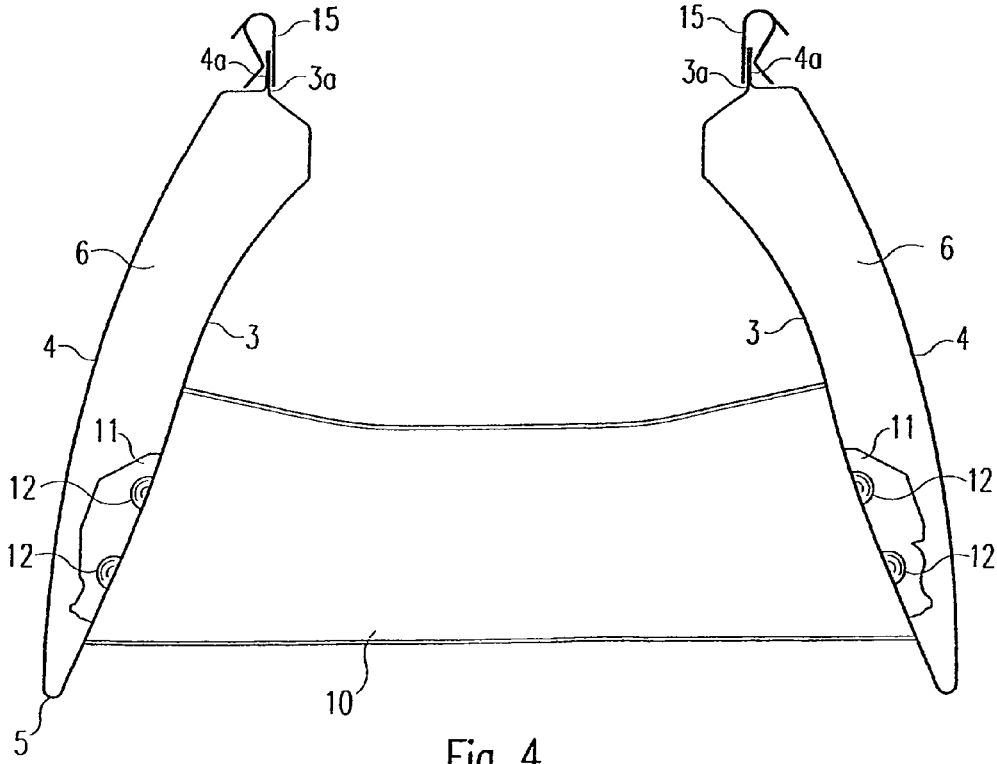
FIG. 4 is a cross section view of the luminaire louvre shown in FIG. 1.

The recesses 7 at the inner wall 3 of the side reflectors 2, provided for latching with the transverse lamellas 10, are illustrated in FIG. 2. The recesses 7 are, corresponding to the V-shaped of the transverse lamellas, roughly considered, triangle shaped with the apex downwardly. At their upper side they have in each case two slots 8 continuing the V-shape, into which slots the brackets 11 arranged in the end faces of the transverse lamellas 10 engage. The slots 8 thereby form a guide and a retention for the upper side of the brackets 11 and have the task of preventing that the brackets 11 move inwardly under a corresponding pressure. The latching of the transverse lamella 10 with the side walls 3 is additionally improved by means of the knob-like projections 12, which in each case engage claw-like behind the recesses 7 in the inner walls 3, as is for example illustrated in FIG. 4.

The one-piece nature of the two side reflectors 2 leads, however, to certain problems in the mounting of the transverse lamellas. Upon insertion of the transverse lamellas into the recesses provided therefor, it is necessary to apply a corresponding resistance counter to the mounting pressure of the transverse lamellas. In the case of a double-walled side reflector this is difficult insofar as the counter pressure cannot be exercised on the outer side part. This has the consequence that the outer wall is bent against the end face of the transverse lamella being inserted and hinders its penetration into the opening in the inner wall.

Figure 5A:
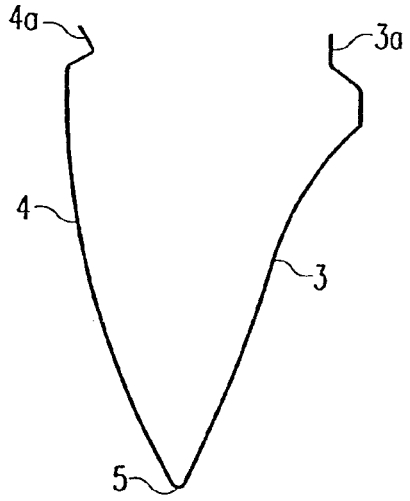
FIG. 5*a* shows an enlarged detail A from FIG. 5*b* walls of a side reflector, before mounting of the transverse lamellas.
Figure 5B:
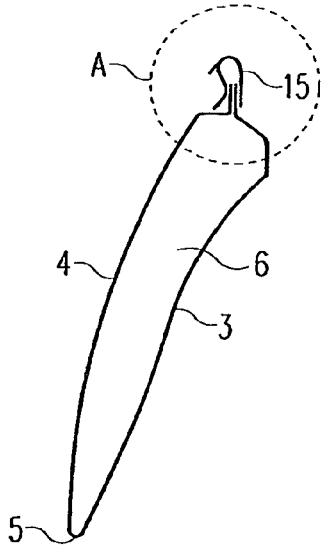
FIG. 5*b* is a view similar to FIG. 5*a* but showing the inner and outer walls in the mounted condition.
Figure 5C:
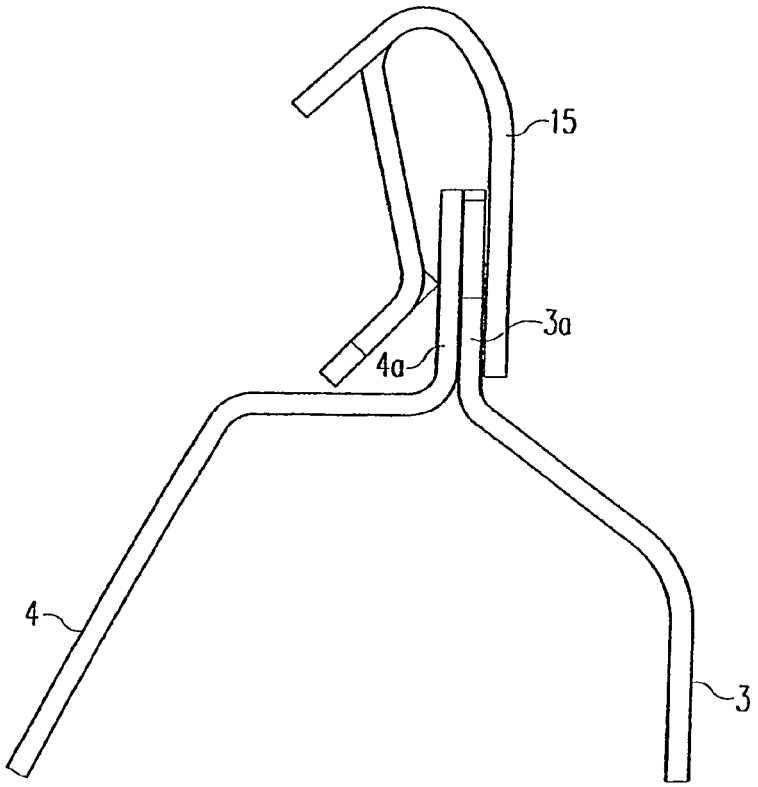
FIG. 5*c* shows an enlarged detail A from FIG. 5*b;*
Figure 6:
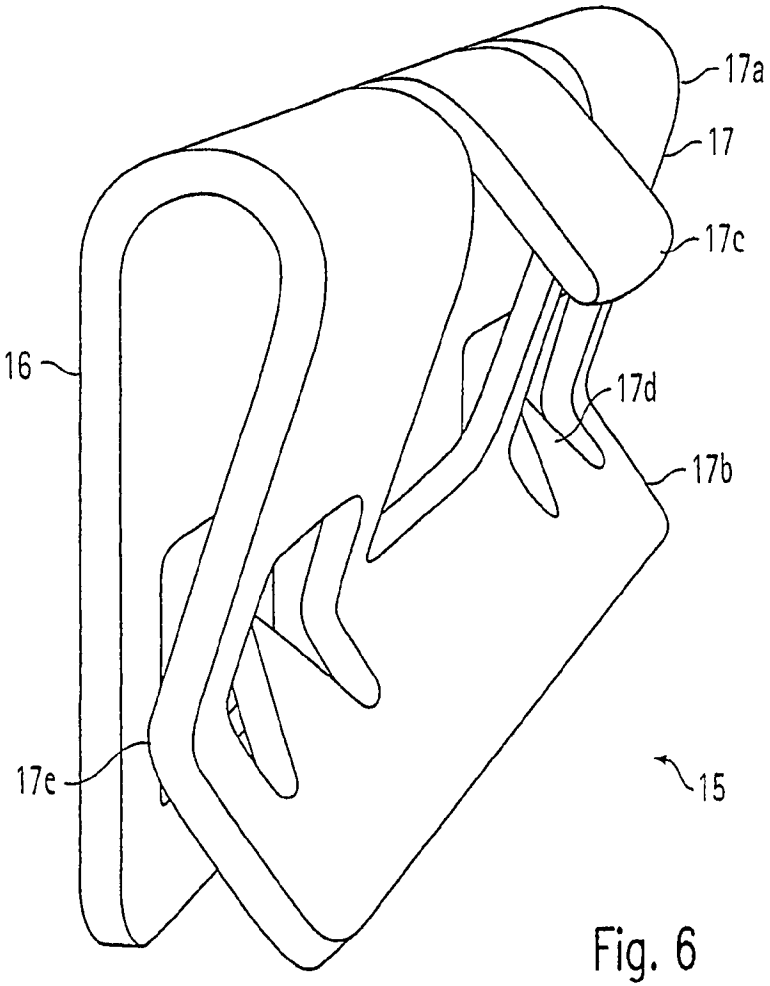
FIGS. 6 and 7 are different perspective views of a clamp element used in the embodiment of FIG. 1.
Figure 7:
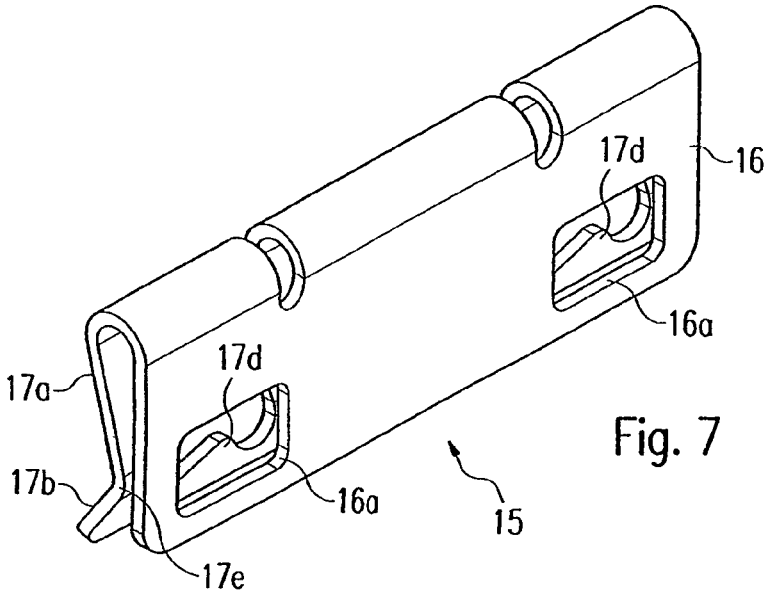
Figure 8:
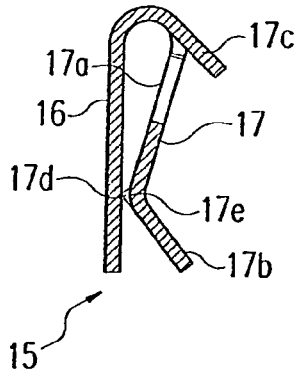
FIG. 8 is a cross section view of the clamp element of FIGS. 6 and 7.
Figure 9:
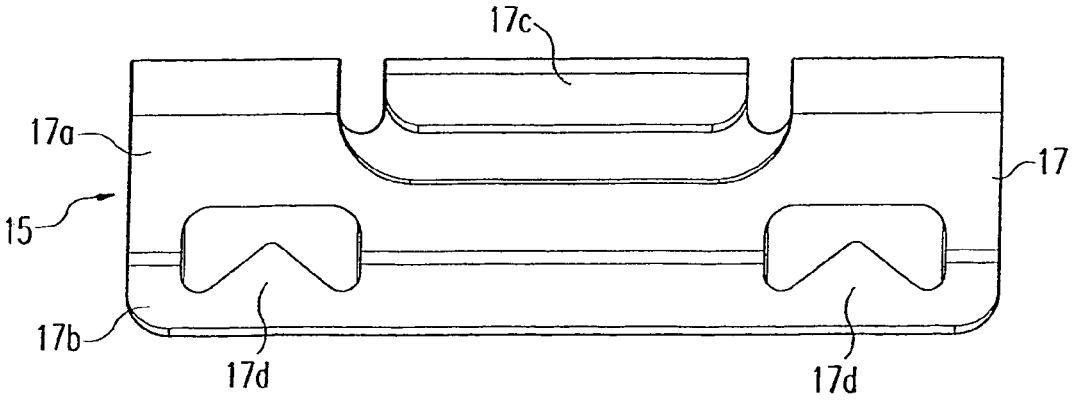
FIG. 9 is a side view of the clamp element of FIGS. 6 and 7.

With the luminaire louvre in accordance with the invention, this problem is avoided in that the side reflectors are initially prefabricated in a shape in which they still stand apart from one another in a V-shape with a relatively great opening angle. Such a structure is illustrated in FIG. 5*a*. The inner wall and the outer wall 4 thereby stand apart from one another with an angle of at least 30°. Through this there is provided the possibility, when mounting the transverse lamellas by hand, also to exercise the counter-pressure on the corresponding inner side of the inner wall 3, until the transverse lamella is latched into its opening in the inner wall 3. In this manner, initially all transverse lamellas are mounted one after another. When the mounting is completed, the side walls 3 and 4, still standing apart from one another in a V-shape, are pressed against one another by means of pressure on the apex 5 by means of an appropriate device, until the upper edges 3*a* and 4*a* of the inner and outer walls 3 and 4 lie against one another and the structure illustrated in FIGS. 5*b* and 5*c* is achieved.

Since, as before, a certain remaining elasticity is present, which attempts to urge the two side walls 3 and 4 apart from one another again, a clamp element 15 is placed on the edge regions 3*a*, 4*a* lying on one another. This clamp element 15, the structure of which will be described below, holds the two side walls 3 and 4 permanently against one another.

The clamp element illustrated in FIGS. 6 to 9 is formed U-shaped or hairpin shaped in section. It has initially a first straight side wall 16 with two first recesses 16*a*. The oppositely lying second side wall 17 is divided into a first section 17*a*, which is directed towards the first side wall 16, and a second section 17*b*, which is bent away from the first side wall 16. There is thus formed between the first section 17*a* and the second section 17*b* a bend edge 17*e*. Further, there are provided in the region of the bend edge 17*e* two further recesses which in each case have a peaked projection 17*d*, which in continuation of the direction of the second section 17*b* projects into the region of the first recess 16*a* of the first side wall 16. The two projections 17*d* thus bring about, in cooperation with the bend edge 17*e* and the first side wall 16, a clamping seating of the clamp element 15 on the two upper edges 3*a*, 4*b* of the side walls 3, 4 of the side reflector, as this is illustrated in FIGS. 5*b* and 5*c*.

In the connection region between the first side wall 16 and the second side wall 17 there is further present a free stamping, through which there is formed a latch nose 17*c*, in the shape of a straight projection, standing out of the U-shaped contour of the clamp element. As will be explained below, this latch nose 17*c* serves for fastening of the luminaire louvre 1 to a luminaire housing. Alternatively to the illustrated structure, the latch nose 17*c* may also be bent back at its forward end and thus formed curved. Significant is that the clamp element 15 is of a material which is permanently springy and has a high resistance to deformation, so that a reliable attachment of the louvre to the luminaire housing is ensured.

Figure 10:
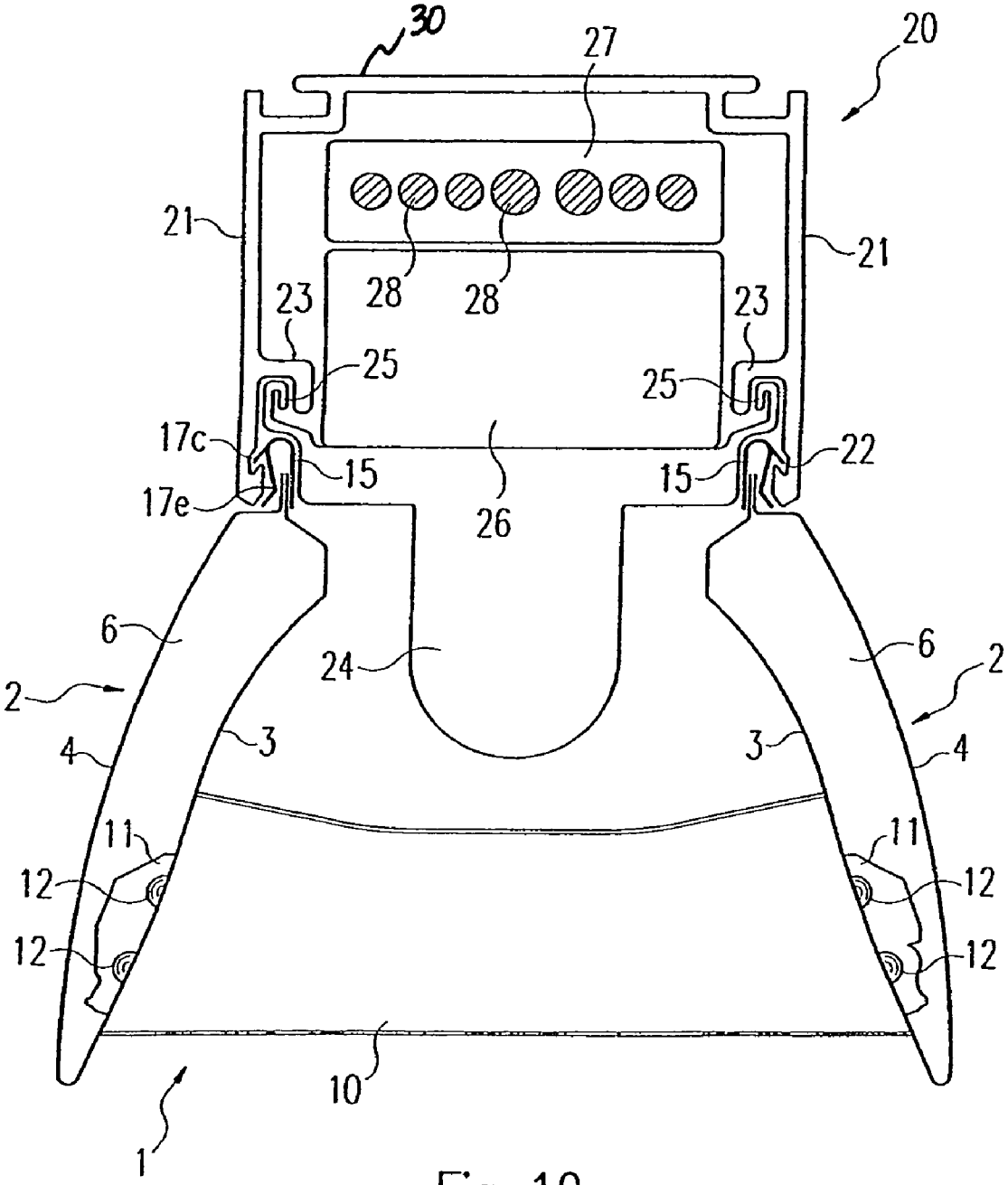
FIG. 10 is a cross sectional view showing the fastening of the luminaire louvre to a luminaire.

Finally, FIG. 10 shows the fastening of the luminaire louvre 1 in accordance with the present invention to a luminaire housing 20. This has a downwardly opened C-shape and may be formed for example by means of a carrier rail of a current rail system. In the interior of the housing 20, which is formed in substance of two side walls 21 and a floor wall 30, there are arranged the electronic component of the luminaire, for example an electronic ballast 26, and corresponding conductor wires 28 which run in a current conductor profile 27. The fastening of the lamp fitting 24 is effected with the aid of two clamp webs 25 which latch with corresponding projections 23 on the inner side of the side walls 21. In their lower region, the two side walls 21 of the luminaire housing 20 further have in each case an elongate recess 22 into which the latch noses 17*c* of the clamp elements 15 can engage. The finished mounted luminaire louvre 1 can thus be clamped onto the underside of the luminaire housing 20 in a simple manner.

By means of the present invention, there is thus indicated a luminaire louvre with has, through the double-wall configuration of the side reflectors, a smooth outer surface. The louvre in accordance with the invention thereby distinguishes itself in particular through its simple and economical structure, whereby additionally the possibility is provided of fastening the louvre to a luminaire in a simple manner.

What is claimed is:

1. Luminaire louvre for an elongate luminaire, said luminaire louvre comprising:

two elongate side reflectors, each of said side reflectors having an inner wall and an outer wall;

a plurality of transverse lamellas; and at least one clamp element engaging and holding together edge regions of said inner and outer walls of one of said side reflector with said edge regions lying on one another, said clamp element including fastening means for fastening the luminaire louvre to a luminaire.

2. Luminaire louvre according to claim 1, wherein the inner wall and the outer wall of each of the side reflectors transition into one another in one piece.

3. Luminaire louvre according to claim 2, wherein the one-piece transition, as seen in cross-section of the luminaire louvre, is located at the ends of the inner and outer walls remote from the luminaire.

4. Luminaire louvre according to claim 2, wherein the edge regions of the inner and outer walls of said side reflector lying opposite to the transition, as seen in cross-section of the luminaire louvre, are held together by the clamp element.

5. Luminaire louvre according to claim 1, wherein the clamp element is formed in substance to include a U-shaped contour.

6. Luminaire louvre according to claim 5, wherein the fastening means are formed by means of a latch nose standing out of the U-shaped contour of the clamp element.

7. Luminaire louvre according to claim 1, wherein the clamp element has a first side wall in which at least one first recess is provided, and wherein the clamp element has a second side wall, which in a first section is directed towards the first side wall and in a second section is bent away from the first side wall, and in the region of the bend edge between the first and the second sections at least one further recess is provided which has a peaked projection which in continuation of the direction of the second section projects into the region of the first recess of the first side wall.

8. Luminaire louvre according to claim 1, wherein the edge regions of the inner and outer walls of each of the side reflectors which lie on one another are held together in each case by means of two clamp elements.

9. Luminaire louvre according to claim 1, wherein the transverse lamellas are fastened with their end faces in each case to the inner walls of the two side reflectors.

10. Luminaire louvre according to claim 9, wherein the transverse lamellas are latched into associated recesses of the inner walls of the two side reflectors.

11. Luminaire louvre according to claim 10, wherein the transverse lamellas are formed in one piece and approximately V-shaped in cross-section, brackets being formed in their end faces, which brackets have knob-like projections.

12. Luminaire louvre according to claim 11, wherein the recesses of the inner walls of the two side reflectors have approximately the shape of an isosceles triangle, the recesses being continued in each case as a slot at the end of a side of the isosceles triangle, and the upper edges of the brackets being held with an exact fit in these slots.

13. Clamp element for a luminaire louvre which is comprised of two elongate side reflectors and a plurality of transverse lamellas and the side reflectors of which in each case have an inner wall and an outer wall, said clamp element being configured to engage over and hold together edge regions of the inner and outer walls of the side reflector which lie on one another, and said clamp element having fastening means for fastening the luminaire louvre to a luminaire.

* * * * *